US005341975A

United States Patent [19]

Marinescu

[11] Patent Number: 5,341,975

[45] Date of Patent: Aug. 30, 1994

[54] COMBINATION TOOL POUCH AND CLIP ASSEMBLY

[76] Inventor: Ilie Marinescu, 25-29 32nd St., Apt. 2B, Astoria, N.Y. 11102

[21] Appl. No.: 65,483

[22] Filed: May 24, 1993

[51] Int. Cl.[5] ..... F41C 33/02; A45F 3/04

[52] U.S. Cl. ..... 224/252; 224/904; 224/269

[58] Field of Search ..... 224/904, 252, 253, 269

[56] References Cited

U.S. PATENT DOCUMENTS

| | | | |
|---|---|---|---|
| 3,091,378 | 5/1963 | O'Dwyer | 224/252 |
| 3,250,448 | 5/1966 | Clark | 224/252 |
| 4,253,593 | 3/1981 | Pattermann | 224/904 X |
| 4,524,892 | 6/1985 | Ozeki | 224/904 X |
| 4,886,196 | 12/1989 | Plummer | 224/252 X |
| 4,903,745 | 2/1990 | Roman | 224/252 X |
| 4,923,105 | 5/1990 | Synder | 224/252 X |
| 5,201,447 | 4/1993 | Bumb et al. | 224/252 X |

*Primary Examiner*—Ernest G. Cusick
*Attorney, Agent, or Firm*—Richard L. Miller

[57] ABSTRACT

A combination tool pouch and clip assembly is provided which consists of a tool pouch having a rear wall with an upper portion extending above a plurality of pockets which hold various tool therein. A clip assembly is also provided, with a structure for retaining the clip assembly behind the upper portion of the rear wall. The clip assembly can be quickly placed upon and removed from a waist belt, a waist and other locations on a garment worn by a person using the tool pouch.

3 Claims, 2 Drawing Sheets

COMBINATION TOOL POUCH AND CLIP ASSEMBLY

BACKGROUND OF THE INVENTION

The instant invention relates generally to article holding apparatuses and more specifically it relates to a combination tool pouch and clip assembly. Numerous article holding apparatuses have been provided in prior art that are each adapted to be worn on the waist belt or about the waist of a person. For example, U.S. Pat. Nos. 4,881,150 to Oyamada; 4,932,576 to Ashley and 4,974,764 to Cantwell all are illustrative of such prior art.

While these units maybe suitable for the particular purpose to which they address, they would not be as suitable for the purposes of the present invention as heretofore described.

SUMMARY OF THE INVENTION

A primary object of the present invention is to provide a combination tool pouch and clip assembly that will overcome the shortcomings of the prior art devices.

Another object is to provide a combination tool pouch and clip assembly which can be quickly placed upon and removed from a waist belt, a waist or other locations on a garment of a person using the tool pouch.

An additional object is to provide a combination tool pouch and clip assembly in which vertically extending slots in the tool pouch can receive the clip assembly, instead of a belt and be retained together by a fastener, so that the tool pouch and clip assembly can now become one complete unit to be utilized by a person.

A further object is to provide a combination tool pouch and clip assembly that is simple and easy to use.

A still further object is to provide a combination tool pouch and clip assembly that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The figures on the drawings are briefly described as follows.

DETAILED DESCRIPTION OF THE PREFERRED EMBODIMENTS

Figure 1:
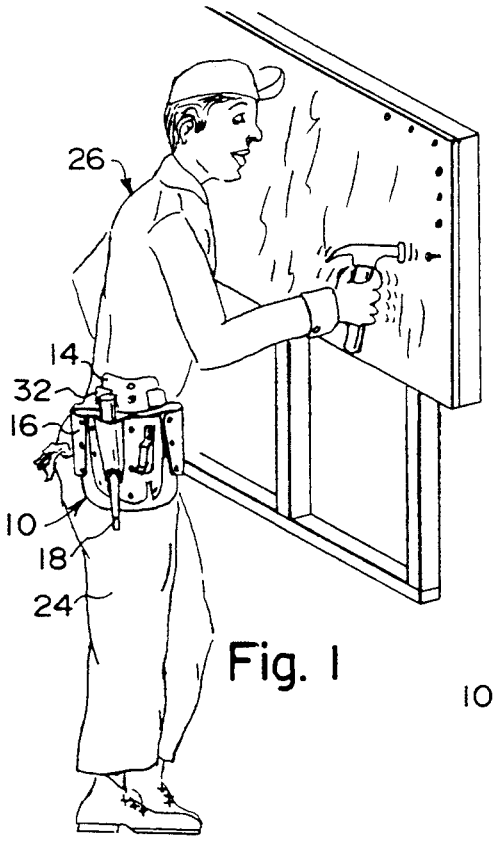
FIG. 1 is a diagrammatic perspective view illustrating the instant invention in use.
Figure 2:
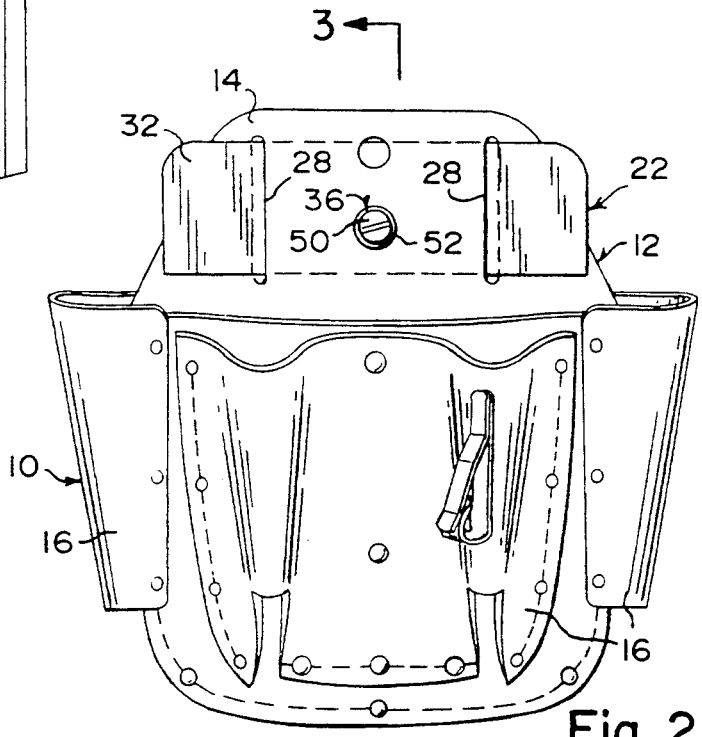
FIG. 2 is an enlarged front elevational view of the instant invention.
Figure 3:
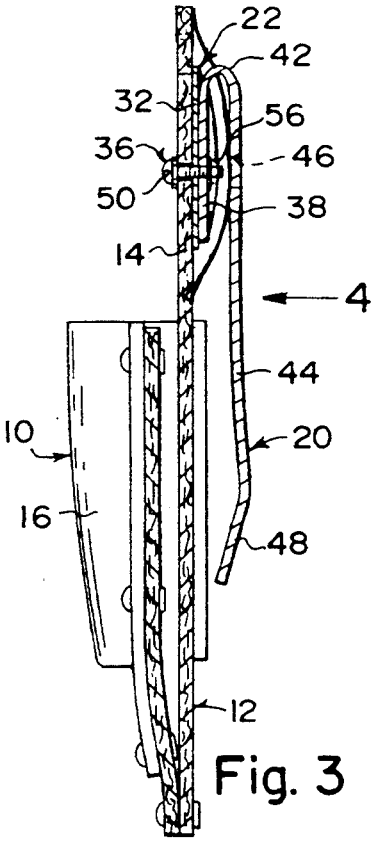
FIG. 3 is a cross sectional view taken on line 3—3 of FIG. 2.
Figure 4:
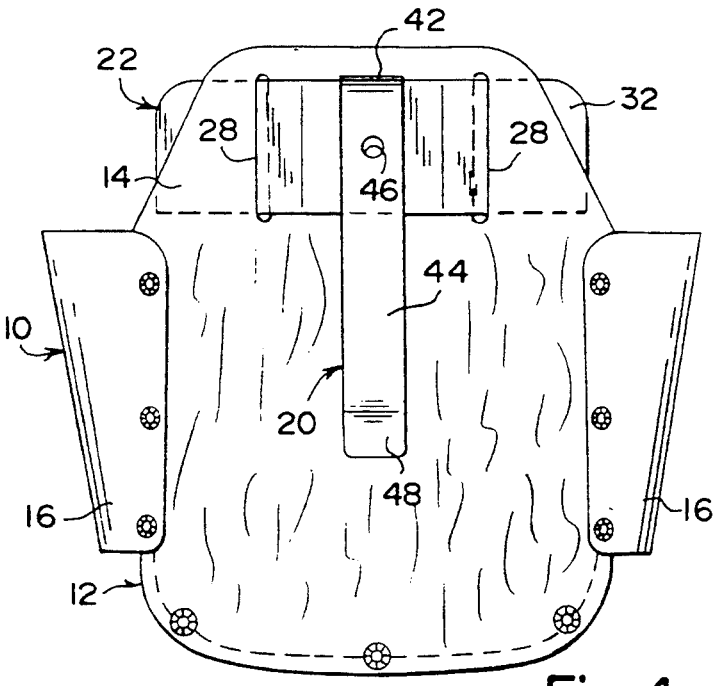
FIG. 4 is a rear elevational view taken in the direction of arrow 4 in FIG. 3.
Figure 5:
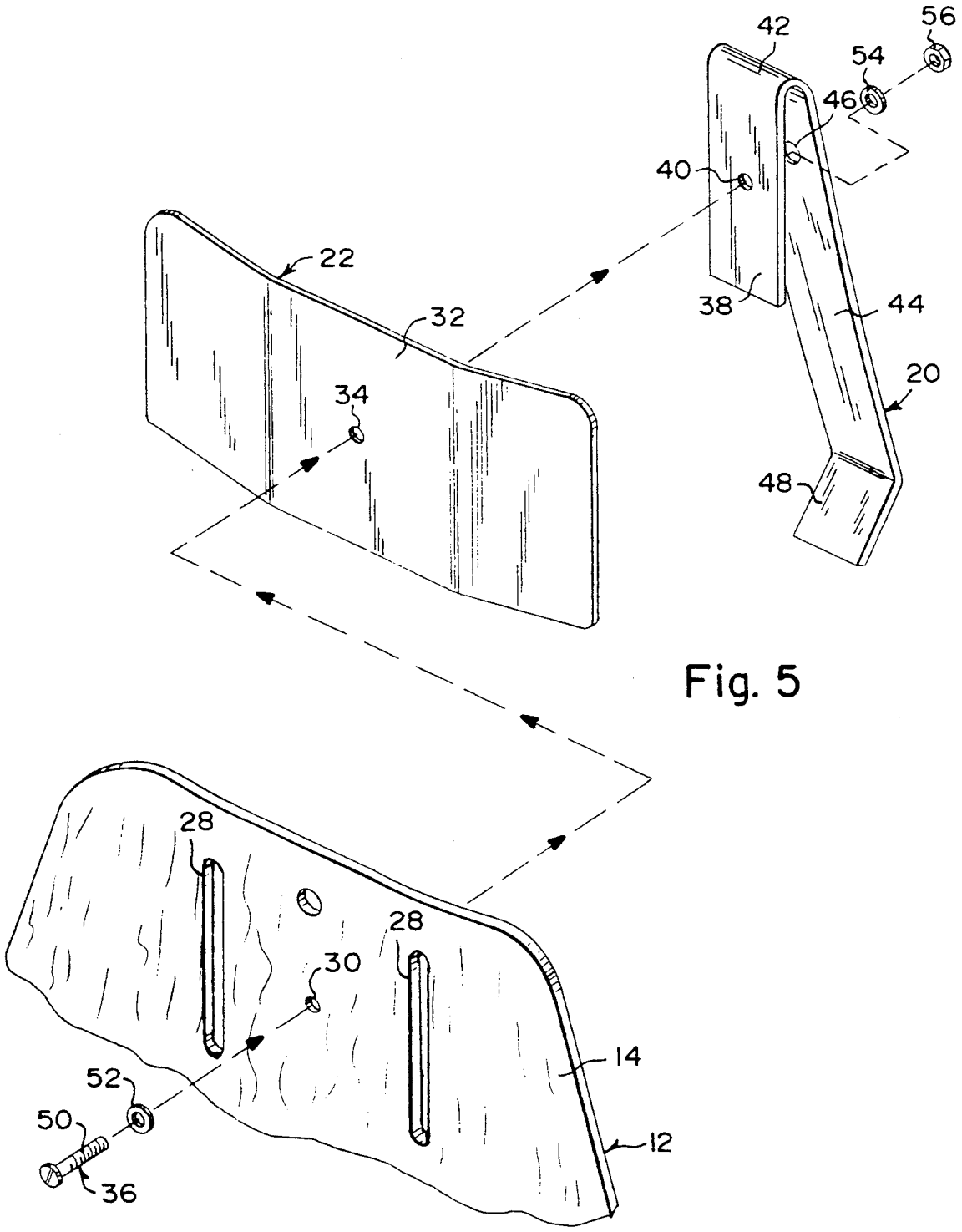
FIG. 5 is an enlarged diagrammatic exploded perspective view with parts broken away of the instant invention per se.

Turning now descriptively to the drawings, in which similar reference characters denote similar elements throughout the several views, FIGS. 1 through 5 illustrate a combination tool pouch and clip assembly which consists of a tool pouch 10 having a rear wall 12 with an upper portion 14 extending above a plurality of pockets 16 which hold various tools 18 therein. A clip assembly 20 is also provided, while a structure 22 is for retaining the clip assembly 20 behind the upper portion 14 of the rear wall 12. The clip assembly 20 can be quickly placed upon and removed from a waist belt, a waist and other locations on a garment 24 worn by a person 26 using the tool pouch 10.

The retaining structure 22 includes the upper portion 14 of the rear wall 12 having a pair of spaced apart vertically extending belt slots 28 and a central aperture 30 between the slots 28. A slightly curved rectangular plate 32 is provided having a central aperture 34. The plate 32 can be inserted through the belt slots 28, with the central aperture 34 in the plate 32 in alignment behind the central aperture 30 in the upper portion 14 of the rear wall 12. A device 36 is for fastening the clip assembly 20 behind the plate 32 via the central aperture 30 in the upper portion 14 of the rear wall 12 and the central aperture 34 in the plate 32.

The clip assembly 20 is fabricated out of a single strip of resilient material, typically metal and is bent to form a short let 38 having an aperture 40 therethrough, a curved top 42, a long leg 44 having an aperture 46 therethrough in alignment with the aperture 40 in the short leg 38 and a bent in bottom end portion 48. The aperture 40 in the short leg 38 is in alignment with the aperture 46 in the long leg 44.

The fastening device 36 contains a bolt 50, a pair of washers 52, 54 and a nut 56. The first washer 52 is placed in front of the central aperture 30 in the upper portion 14 of the rear wall 14. The second washer 54 is placed in back of the aperture 40 in the short leg 38. The bolt 50 is placed through the first washer 52, the central aperture 30 in the upper portion 14 of the rear wall 12, the central aperture 34 in the plate 32, the aperture 40 in the short leg 38 and the second washer 54, while the nut 56 is threaded onto a distal end of the bolt 50.

It is obvious that a host of other fastening devices could can substitute for the fastener 36, typically but not limited to rivets, eyelets, etcetera to mention just a few.

OPERATION OF THE INVENTION

To use the combination tool pouch and clip assembly the person 26 can either assemble the clip assembly 20 via the retaining structure 22 to the upper portion 14 of the rear wall 12 of the tool pouch 10, purchase the device in the already assembled condition depending upon the manufactures choice. The clip assembly 20 can be engage with and disengage from the waist belt, waist and other locations on the garment 24. This eliminates the need of placing a belt through the belt slots 28 in the upper portion 14 of the tool pouch 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A combination tool pouch and clip assembly which comprises:

a) a tool pouch having a rear wall with an upper portion of said rear wall extending above a plurality of pockets which hold various tools therein;

b) a clip assembly; and c) means for retaining said clip assembly behind said upper portion of said rear wall, so that said clip assembly can be quickly placed upon and removed from a waist belt and locations on a garment worn by a person using said tool pouch, wherein said retaining means includes:

i) said upper portion of said rear wall having a pair of spaced apart vertically extending belt slots and a central aperture between said belt slots;

ii) a slightly curved rectangular plate having a central aperture, whereby said plate can be inserted through said belt slots, with said central aperture in said plate in alignment behind said central aperture in said upper portion of said rear wall; and iii) means for fastening said clip assembly behind said plate via said central aperture in said upper portion of said rear wall and said central aperture in said plate.

2. A combination tool pouch and clip assembly as recited in claim 1, wherein said clip assembly is fabricated out of a single strip of resilient material bent to form a short leg having an aperture therethrough, a curved top, a long leg having an aperture therethrough in alignment with said aperture in said short leg and bent in bottom end portion, wherein said aperture in said short leg is in alignment with said aperture in said long leg.

3. A combination tool pouch and clip assembly as recited in claim 2, wherein said fastening means includes a bolt, a pair of washers and a nut, whereby said first washer is placed in front of said central aperture in said upper portion of said rear wall, said second washer is placed in back of said aperture in said short leg, said bolt is placed through said first washer, said central aperture in said upper portion of said rear wall, said central aperture in said plate, said aperture in said short leg and said second washer, while said nut is threaded onto a distal end of said bolt.

* * * * *